US006251062B1

(12) United States Patent
Leysieffer

(10) Patent No.: US 6,251,062 B1
(45) Date of Patent: Jun. 26, 2001

(54) IMPLANTABLE DEVICE FOR TREATMENT OF TINNITUS

(75) Inventor: Hans Leysieffer, Taufkirchen (DE)

(73) Assignee: IMPLEX Aktiengesellschaft Hearing Technology, Ismaning (DE)

( * ) Notice: Subject to any disclaimer, the term of this patent is extended or adjusted under 35 U.S.C. 154(b) by 0 days.

(21) Appl. No.: 09/372,172

(22) Filed: Aug. 11, 1999

(30) Foreign Application Priority Data

Dec. 17, 1998 (DE) ..... 198 58 398

(51) Int. Cl.[7] ..... H04R 25/00
(52) U.S. Cl. ..... 600/25
(58) Field of Search ..... 600/25, 559; 607/55–57, 607/136–137

(56) References Cited

U.S. PATENT DOCUMENTS

| | | |
|---|---|---|
| 5,015,225 | 5/1991 | Hough et al. . |
| 5,277,694 | 1/1994 | Leysieffer et al. . |
| 5,279,292 | 1/1994 | Baumann et al. . |
| 5,498,226 | 3/1996 | Lenkauskas . |
| 5,624,376 | 4/1997 | Ball et al. . |
| 5,755,743 | 5/1998 | Volz et al. . |
| 5,788,711 | 8/1998 | Lehner et al. . |
| 5,795,287 | 8/1998 | Ball et al. . |
| 5,814,095 | 9/1998 | Muller et al. . |

FOREIGN PATENT DOCUMENTS

| | | |
|---|---|---|
| 0 499 940 | 8/1992 | (EP) . |
| WO 90/07251 | 6/1990 | (WO) . |

OTHER PUBLICATIONS

Horakustik, Tinnitus–Retraining–Therapie und Horakustik, Die Kunf–Tigen Aug–Gaben der Horgerate–Akustiker 2/97, pp. 26 and 27.

*Primary Examiner*—John P. Lacyk
(74) *Attorney, Agent, or Firm*—Nixon Peabody LLP; David S. Safran

(57) ABSTRACT

An implantable device for treatment of tinnitus is provided comprising an electronic signal generation unit and a power source for supplying power. A hermetically gas-tight, biocompatible and implantable electroacoustic transducer is also provided as the sound-delivering output transducer which, after an at least partial mastoidectomy, can be positioned in the mastoid cavity such that the sound emitted from the electroacoustic transducer travels from the mastoid to the tympanic cavity via the natural passage of the aditus ad antrum.

44 Claims, 8 Drawing Sheets

FIG. 5
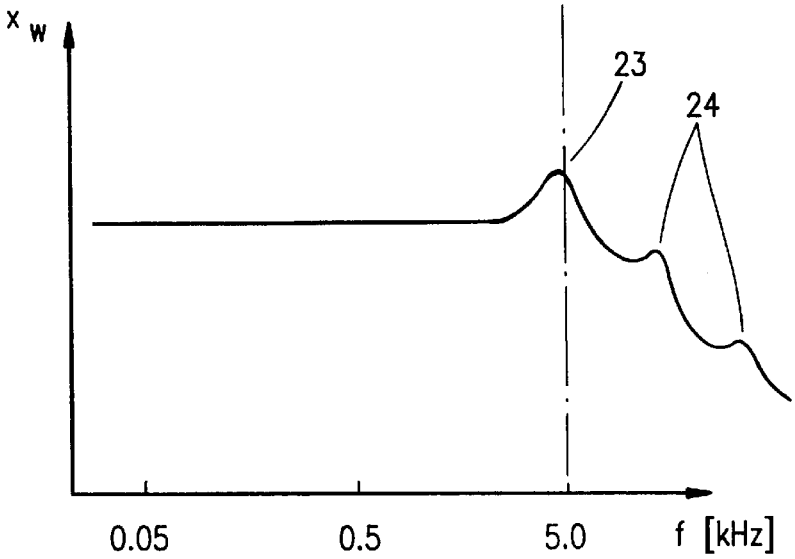
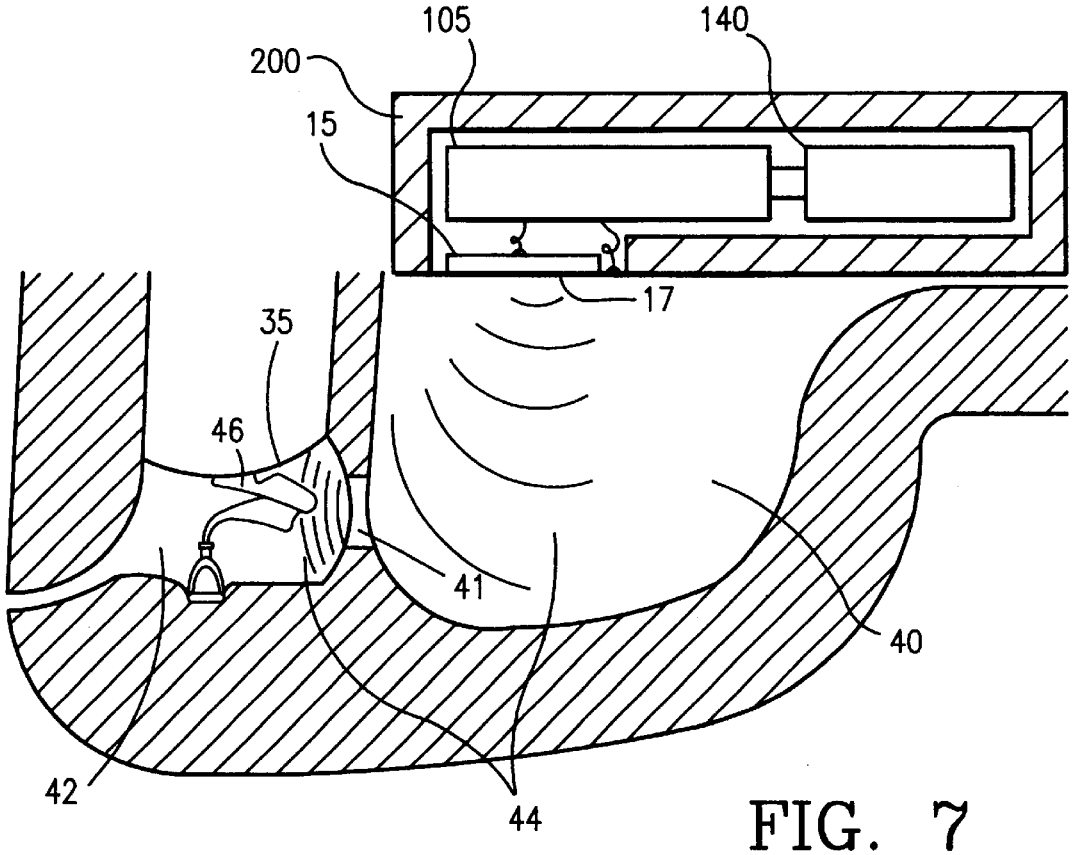
FIG. 7

IMPLANTABLE DEVICE FOR TREATMENT OF TINNITUS

BACKGROUND OF THE INVENTION

1. Field of the Invention

The invention relates to an implantable device for treatment of tinnitus which includes an electronic signal generation unit and a power source for power supply of the device.

2. Discussion of Related Art

Many individuals suffer from intermittent or permanent tinnitus which cannot be cured by surgery. Also, to date, there have been no approved drug forms of treatment for tinnitus. However, so-called tinnitus maskers are known, such as disclosed in published PCT application 90/07251. These maskers are small, battery-operated devices which are worn like a hearing aid behind or in the ear and cover (mask) the tinnitus psychoacoustically by artificial sounds which are emitted, for example, via a hearing aid speaker into the auditory canal and which reduce the disturbing tinnitus as far as possible below the threshold of perception. The artificial sounds are often narrowband noise (for example, third octave noise) which in its spectral position and its loudness level can be adjusted via a programming device to enable the maximum possible adaptation to the individual tinnitus situation.

Moreover, recently the so-called "retraining method" has been provided according to which, by combination of a metal training program and presentation of broadband sound (noise) near the hearing threshold, the perceptibility of the tinnitus is supposed to be largely suppressed (see the journal "Hoerakustik" 2/97, pages 26 and 27).

In the two aforementioned methods, technical devices similar to hearing aids can be visibly carried externally on the body in the area of the ear. As a result, these devices stigmatize the wearer and therefore are not willingly worn.

Furthermore, there are currently partially and fully implantable hearing aids for rehabilitation of inner ear impairment such as disclosed in published European patent application Nos. 0 499 940, and 0 831 674, U.S. Pat. Nos. 5,279,292; 5,498,226; 5,624,376; and 5,795,287. In fully implantable systems, the system is not visible, so that in addition to the advantages of high sound quality and the open auditory canal, high acceptance can be assumed.

U.S. Pat. No. 5,795,287 describes an implantable tinnitus masker with direct drive of the middle ear, for example via an electromechanical transducer which is coupled to the ossicle chain. This directly coupled transducer can preferably be a so-called "floating mass transducer" (FMT). This FMT corresponds to the transducer for implantable hearing aids described in U.S. Pat. No. 5,624,376. U.S. Pat. No. 5,795,287 clearly describes the concept of "direct drive" which is explicitly defined as drives including only the types of couplings to the inner ear for purposes of tinnitus masking which are of a mechanical nature. For example, direct drive couplings include direct mechanical converter couplings to one ossicle of the middle ear, such as for example by the FMT converter, and also air gap-coupled electromagnetic converters, such as for example described by Maniglia in U.S. Pat. No. 5,015,225.

All these electromechanical coupling types have the fundamental and serious disadvantage that the surgery for implantation of the entire masker system, or even only the electromechanical transducer, requires fundamentally mechanical manipulations on the ossicle chain of the middle ear or directly at the entry area of the inner ear (oval or round window) and thus involve a considerable risk of inner ear impairment. Furthermore, the necessary surgical opening of an sufficiently large access to the middle ear from the mastoid, for example in the area of the chorda facialis angle (med: "dorsal tympanotomy", as is necessary in the application of the FMT, can also involve the serious risk of facialis damage and the associated partial paralysis of the face. Furthermore, it cannot always be guaranteed that mechanical coupling will be of a long term, stable nature or that additional clinical damage will not occur, for example, pressure necroses in the area of the middle ear ossicle.

SUMMARY OF THE INVENTION

The aforementioned disadvantages are diminished or completely circumvented by the present invention providing a hermetically gas-tight, biocompatible and implantable electroacoustic transducer in an implantable device for treatment of the tinnitus which is provided with an electronic signal generation unit and a battery for power supply as the sound-delivering output transducer. The electroacoustic transducer is designed such that, after at least partial mastoidectomy, it can be positioned in the mastoid cavity to permit the sound emitted from the electroacoustic transducer to travel via the natural passage of the aditus ad antrum from the mastoid to the tympanic cavity in the area of the middle ear. This sound causes mechanical vibrations of the eardrum which travel via mechanical transmission through the middle ear ossicle to the inner ear or via direct acoustic excitation of the oval or round window of the inner ear. In this manner, these vibrations cause an auditory sensation and thus the desired masking and noiser effect. In the device of the present invention, the implantable output transducer therefore works electroacoustically, not electromechanically.

In another embodiment of the present invention, the electroacoustic transducer includes a preferably metal housing which is hermetically gas-tight on all sides. The housing includes one wall made as a bendable, preferably circular membrane. An electromechanical drive unit is positioned in the housing and coupled to the housing membrane such that output-side mechanical vibrations of the drive unit are mechanically coupled directly from the inside to the housing membrane. In this way, the membrane is excited to bending vibrations which cause sound emission outside the transducer housing. In doing so, the inside electromechanical drive unit may be based on all known converter principles, such as especially piezoelectric, dielectric, electromagnetic, electrodynamic and magnetostrictive.

The transducer housing is preferably cylindrical, especially circular cylindrical, and open on one side. The open side is sealed hermetically gas-tight by the transducer membrane. The transducer housing part and/or the transducer membrane may be produced from a noncorrosive, stainless metal, especially high-quality steel, or from a noncorrosive, stainless and especially physiologically compatible metal, such as titanium, platinum, niobium, tantalum or their alloys.

In one case, when in the implanted state, the electroacoustic transducer is mounted separately from the electronic signal generation unit. Preferably, the transducer housing part is provided with an at least single pole, hermetically gas-tight electrical housing feed-through, wherein the ground potential is on the transducer housing part. The housing feed-through can advantageously be based on a metal-ceramic connection which has been soldered gas-tight. The insulator may include an aluminum oxide ceramic and the electrical feed-through lead may include at least one platinum-iridium wire.

The electromechanical drive unit is preferably a piezoelectric ceramic wafer which can be made circular and which is applied to the inside of the transducer membrane as the electromechanically active element and together with the transducer membrane represents an electromechanically active heteromorph compound element. In this case, as in a bimorph element, the transverse piezoelectric effect is used. However, the partner of the compound in this case does not consist of a second piezoelectrically active element, but of the passive transducer membrane of similar geometry to the piezoelement. The piezoelectric ceramic wafer can be provided on both sides with a very thin, electrically conductive coating used as the electrode surface. The ceramic material may consist of lead zirconate titanate. When an electrical field is applied to the piezoelectric ceramic wafer, the wafer changes its geometry preferably in the radial direction as a result of the transverse piezoeffect. Since lengthening or radial shortening however is prevented by the mechanically strong connection to the passive transducer membrane, sagging of the compound element in the middle results. This sagging is maximum with the corresponding edge support of the membrane.

The thickness of the transducer membrane and the thickness of the piezoelectric ceramic wafer are approximately the same, i.e. in the range from 0.025 mm to 0.15 mm. One especially simple and reliable structure is obtained when both the transducer membrane and also the transducer housing part are electrically conductive, the piezoelectric ceramic wafer is connected electrically conductively to the transducer membrane by an electrically conductive cement, and the transducer housing part forms one of at least two electrical transducer terminals. The radius of the transducer membrane is advantageously larger than the radius of the piezoelectric ceramic wafer by a factor of 1.2 to 2.0, and preferably by a factor of approximately 1.4.

According to one modified embodiment of the invention, the electromechanical drive unit is made as an electromagnet arrangement having a component which is fixed relative to the transducer housing and a vibratory component which is coupled to the inside of the transducer membrane. By using the electromagnetic converter principle, a frequency response of the electroacoustic transducer, which is especially favorable for low frequencies of the hearing range, can be achieved. As a result, a proper hearing sensation is achieved with a sufficient loudness level even with low electrical voltages.

The vibratory component of the electromagnet arrangement is preferably attached essentially in the center of the transducer membrane. In particular, a permanent magnet, which forms the vibratory component, can be connected to the inside of the transducer membrane, while an electromagnetic coil is securely attached in the transducer housing to cause the permanent magnet to vibrate. The permanent magnet may be made as a magnet pin and the coil may be a ring coil with a center opening into which the magnet pin dips. In this way, a transducer arrangement with an especially small moving mass is obtained and changes of the electrical signal applied to the magnet coil can take place quickly and reliably. But it is also fundamentally possible to attach the magnet coil to the vibratory membrane and to fix the magnet relative to the transducer housing.

Regardless of the converter principle provided in the individual application, by selecting the mechanical properties of the transducer membrane and the converter/drive unit, the vibratory system, which comprises these components, is tuned such that the first mechanical resonant frequency of the entire transducer lies spectrally on the upper end of the transmission range. Preferably the converter/drive unit is electrically triggered such that the deflection of the transducer membrane is impressed as far as the first resonant frequency, regardless of the frequency. Preferably, the signal generation unit of the device of the present invention can be adjusted or programmed. According to one embodiment of the present invention the electroacoustic transducer is held in an implantable positioning and fixing system and aligned to the aditus ad antrum by means of this system.

The device can be made as a partially implantable device in which the implant includes an electroacoustic transducer and an assigned signal receiving and driver circuit. In this case, the nonimplantable device unit contains the signal generation unit and the electric power supply. But preferably the device is made as fully implantable. In this case, the signal generation unit together with the electric power supply, but separately from the electroacoustic transducer, can be accommodated in an implantable, hermetically tightly sealed implant housing and connected to the electroacoustic transducer via an implantable electric converter lead wire. The transducer lead wire may be connected to the implant housing via a detachable connector. The electroacoustic transducer however can also be integrated into an implantable, hermetically tightly sealed implant housing which holds the signal generation unit and the electric power supply.

In the latter embodiment, a partial area of the hermetically tight implant housing which comes to rest in the implanted state over the area of the aditus ad antrum can be made as a transducer membrane. The implant housing is then configured geometrically such that it can be positioned and fixed over the artificial mastoid cavity. Also, preferably a sound conduction element is attached to the implant housing in the area of the transducer membrane, with the side at a distance from the transducer membrane coming to rest in the implanted state opposite the aditus ad antrum. Optionally, the implant housing can also be kept so small that it has room in the artificial mastoid cavity.

The electronic unit within the implant is preferably provided with at least two signal generators which can be adjusted with respect to frequency position, mutual phase angle, output level and/or spectral composition of the generated signals. The signal generators may also be programmed by means of a microprocessor. The electronic unit further includes a summing element for combining the signals of the signal generators. Thus, advantageously, an implantable receiving coil is provided for transcutaneous reception of program data for the microprocessor. Also a data transmitter interface is provided for transmission of the received program data from the receiving coil to the microprocessor.

According to one modified embodiment of the invention, the device includes a microprocessor which is used for signal generation, an implantable receiving coil for transcutaneous reception of program data for the microprocessor, and a data transmitter interface for transmission of the received program data from the receiving coil to the microprocessor. A driver amplifier is preferably connected upstream of the electroacoustic transducer. The driver amplifier gain may be adjusted by means of the microprocessor.

The battery can be recharged preferably via a transcutaneous charging link. The device may be equipped with a portable, battery-operated remote control unit and/or with a programming unit which has a telemetry head for transcutaneous transfer of programming data to the implant and/or for transcutaneous readout of data from the implant.

BRIEF DESCRIPTION OF THE DRAWINGS

FIG. 5 is a graph showing one example of center point displacement of the transducer membrane of the electroacoustic transducer in a tinnitus masker or noiser of the present invention relative to frequency;

FIGS. 6 to 9 illustrate different embodiments of fully implantable tinnitus maskers or noisers of the present invention;

DETAILED DESCRIPTION OF THE INVENTION

Figure 1:
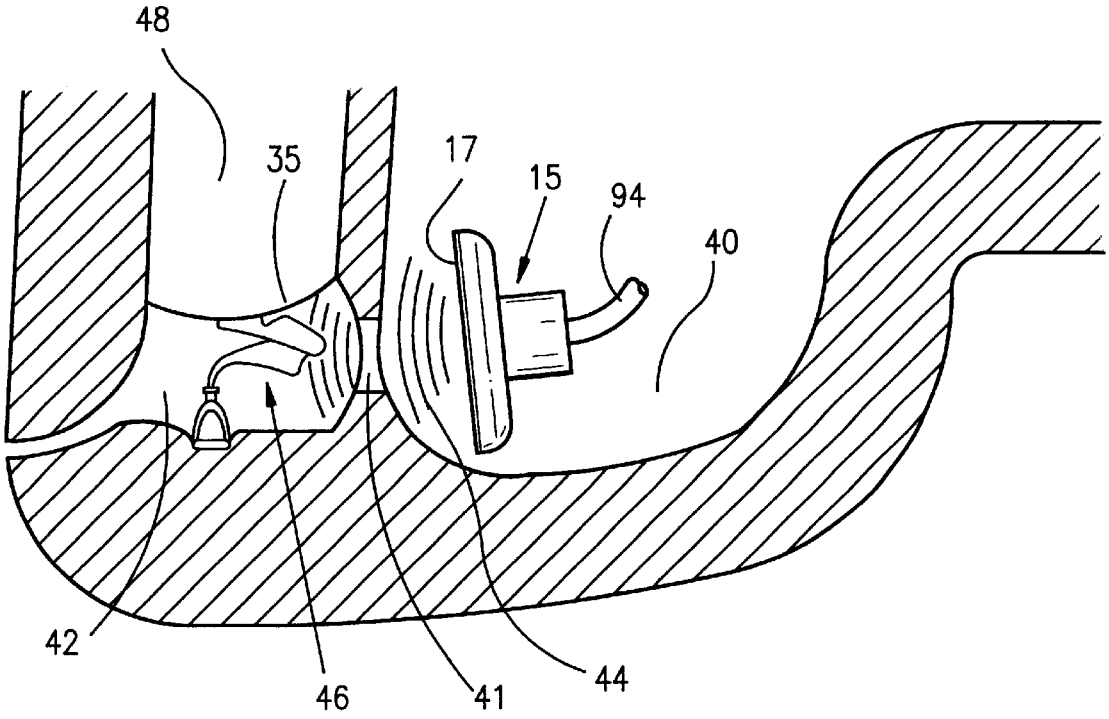
FIG. 1 illustrates the arrangement of an electroacoustic transducer of the present invention in an artificial mastoid cavity near the aditus ad antrum.

The basic principle of the tinnitus treatment device of the present invention is shown in FIG. 1 with only the electroacoustic transducer 15 of the device being shown. The transducer 15 sits in the implanted state in an artificial mastoid cavity 40 which is openly connected, via the aditus ad antrum 41, to the tympanic cavity 42. During operation, the membrane 17 of the transducer 15, positioned opposite the aditus ad antrum 41, emits sound waves 44 which pass into the tympanic cavity 42 causing the eardrum 35 to vibrate mechanically. Depending on the existing individual anatomical aspects, it may be necessary to surgically slightly widen the aditus ad antrum 41 during implantation after completed (partial) mastoidectomy in order to ensure reliable passage of sound from the mastoid cavity 40 into the tympanic cavity 42. Mechanical vibrations travel via mechanical transmission through the middle ear ossicle chain 46 to the inner ear causing an auditory impression via direct acoustic excitation of the oval or round window of the inner ear. In this way, the desired masker or noiser effect is achieved. In FIG. 1, the outer auditory canal is indicated at 48.

In the following description, the term "implant system" is defined as an implantable system which can act as a tinnitus masker or function as a noiser. The implant system comprises, in addition to the electroacoustic output transducer 15 which is basically implanted, an electronic unit 105 for generating the masker or noiser signals, and an electric power supply 140 which can consist of a primary battery or a rechargeable battery. The electronic unit 105 may be programmed wirelessly or over a wire or can be adjusted by the patient himself. Basically, it is also possible to build a partially or fully implantable implant system. In a partial implant, for example, only the electroacoustic transducer 15 with a corresponding signal receiving and driver circuit is implanted while the signal generating unit 105 including the electric power supply 140 is worn outside on the body like a partially implantable hearing aid. The transducer signal is transmitted to the implanted part, for example, via an inductive coil coupling. A partially implantable system is described, for example, in U.S. Pat. No. 5,795,287. In the following description, therefore, only fully implantable implant embodiments are explained in detail.

Figure 2:
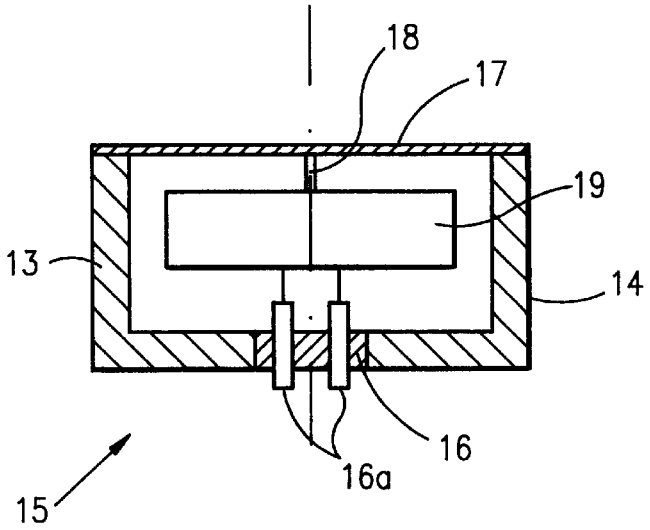
FIG. 2 is a longitudinal cross-sectional view showing the fundamental structure of the electroacoustic transducer of a tinnitus masker or noiser of the present invention.

FIG. 2 illustrates the fundamental structure of the electroacoustic transducer 15. The transducer 15 includes a housing 14 which is closed on all sides and preferably cylindrical, especially circularly cylindrical. All walls of the transducer housing 14 are made mechanically stiff except for the membrane 17 which seals the open side of a housing part 13 hermetically gas-tight. The membrane 17 is connected by a mechanically stiff connecting element 18 to a drive unit 19. The drive unit 19 represents the actual electromechanical transducer which, via the connecting element 18, excites the membrane 17 causing dynamic bending vibrations which lead to sound emission on the outside of the transducer housing 14. The feed of the electrical signal for the electromechanical transducer takes place via a hermetically tight feed-through 16 shown in FIG. 2, for example, with terminals 16*a* in double-pole form.

Figure 3:
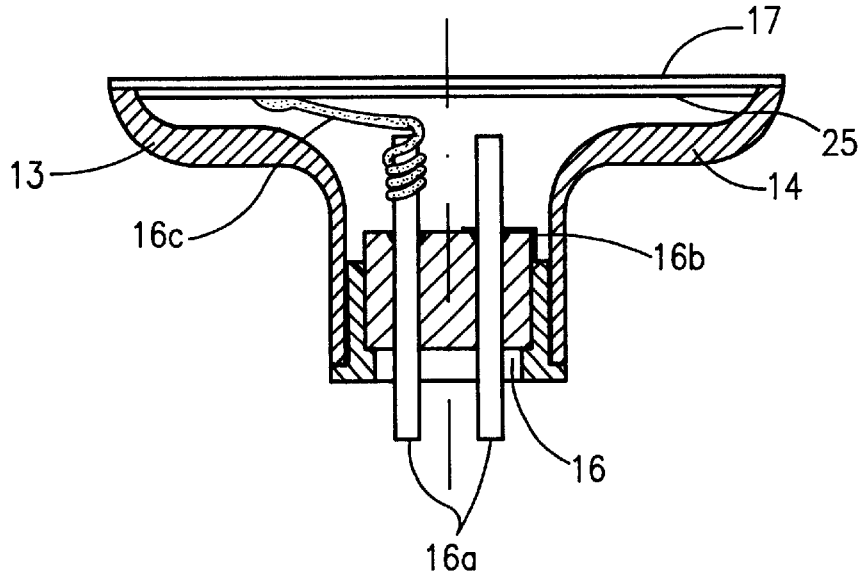
FIG. 3 is a longitudinal cross-sectional view of an electroacoustic transducer of the present invention with a piezoelectric drive unit.

One preferred embodiment of the transducer 15 is shown in FIG. 3. The metallic housing part 13, which is advantageously circular in cross section, is sealed hermetically gas-tight on one side by the likewise metallic transducer membrane 17, for example by a weld. On the inside of the membrane 17, a thin, piezoceramic wafer 25 is connected in a mechanically strong manner to the membrane 17 by means of an electrically conductive adhesive connection. This piezowafer 25 represents the electromechanical converter element and thus the drive unit 19 in FIG. 2. The connecting element 18 in FIG. 2 is the flat adhesive connection between the piezowafer and the membrane in this embodiment. On the one hand, contact is made with the piezowafer 25 on the inner electrode surface via the electrical signal feed-through 16 which is inserted hermetically tight (shown by schematic wire terminals 16*c*). On the other hand, contact is made with the piezowafer 25 on the outer electrode surface via the metallic transducer housing 14, since it is electrically connected via the conductive cement to the outer electrode surface of the piezowafer 25. Electrical connection of one of the two terminals 16*a* to the metallic housing 14 takes place by a conductive contact-making element 16*b*.

If an alternating electrical signal is applied to the terminals 16*a*, as a result of the transverse piezoelectric effect, rotationally symmetrical dynamic bending of the membrane 17 takes place perpendicularly to the plane of the membrane which leads to the described sound emission by the membrane 17.

Figure 4:
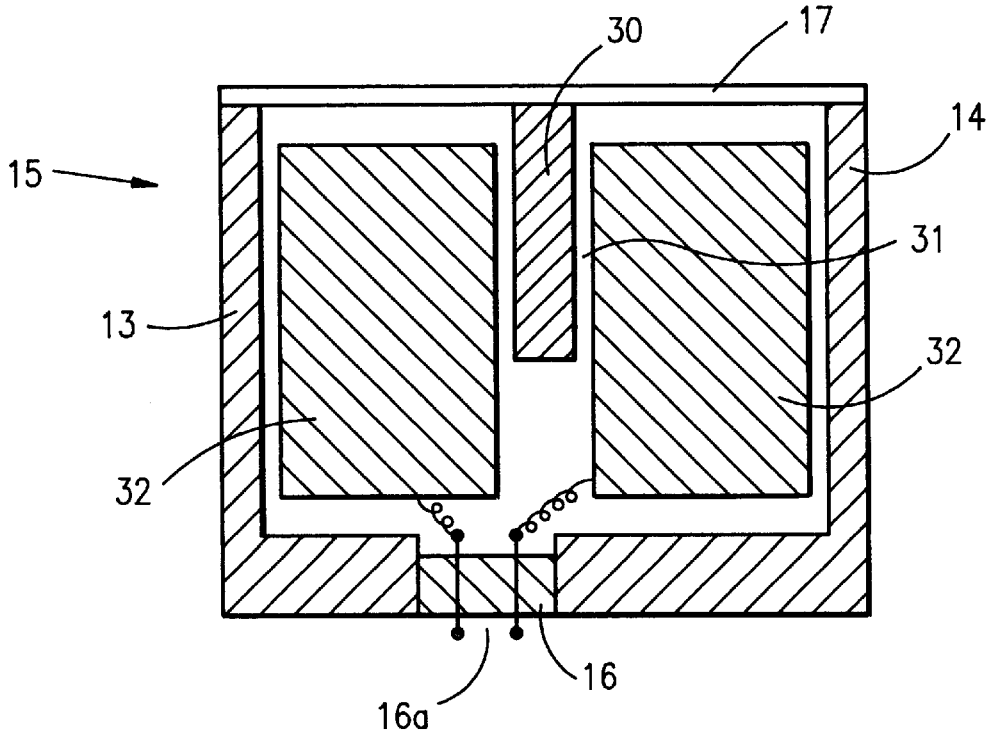
FIG. 4 is a longitudinal cross-sectional view of an electroacoustic transducer with an electromagnetic drive unit of the present invention.

FIG. 4 illustrates another embodiment of the electroacoustic transducer 15 in which the electromechanical drive unit 19 is based on electromagnetic principles. The transducer 15 in turn includes a transducer housing 14 with a preferably cylindrical and mechanically stiff housing part 13 and a preferably circular bendable membrane 17 applied hermetically tight to one face of the housing part. A rod-shaped permanent magnet 30 is securely and mechanically joined to the transducer membrane 17 on the inside and in the middle of the transducer membrane 17. The magnet 30 projects into a central middle opening 31 of an electromagnetic ring coil 22 to form a small air gap. The magnet 30 together with the coil 22 forms the converter/drive unit 19. The coil 32 (shown in FIG. 4 as the air coil) is connected mechanically in a secure manner to the transducer housing 14 and electrically connected to the poles 16*a* of the hermetically tight feed-through 16.

When an AC voltage is applied to the coil 32, the magnet 30 undergoes dynamic deflection perpendicular to the plane of the membrane and thus causes the membrane 17 to execute mechanical bending vibrations around the rest position. This leads to the desired emission of sound waves 44 (FIG. 1) to the outside. The magnetic field guidance, and thus the efficiency of the converter, can be optimized by using the corresponding components within the transducer housing 14 of suitable ferromagnetic materials with the corresponding geometrical design.

FIG. 5 illustrates the desired behavior of the middle point displacement $x_w$ of the transducer membrane 17 over frequency for the case in which the transmission bandwidth should reach at least 5 kHz regardless of the selected implementation principle of the drive unit 19 located within the transducer. In this example, it is apparent that the first mechanical resonant frequency 23 is approximately 5 kHz and therefore on the upper end of the frequency range which is desired. Thus the higher resonances 24 (modes) are outside of the transmission range. This setting to above resonance underneath the first mechanical resonant frequency also yields an emitted sound pressure behavior which is largely independent of frequency in the tympanic cavity 42 (FIG. 1), assuming that the volume into which the sound is emitted can be regarded physically generally as a pressure chamber.

Figure 6:
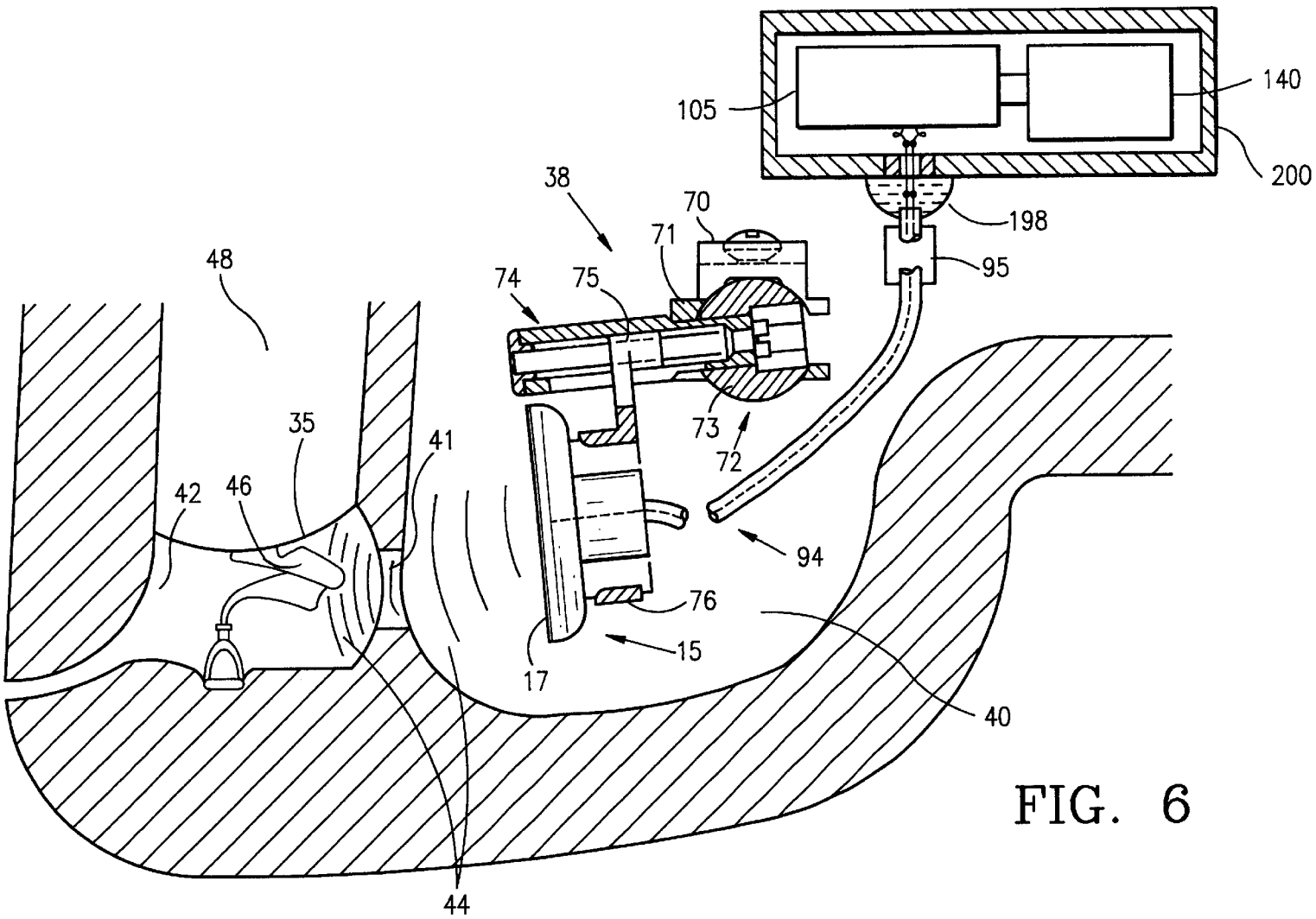

FIG. 6 illustrates a completely implantable implant system using the described electroacoustic transducer 15. The transducer 15 is held with its housing 14 in an implantable positioning and fixing system 38, as is described for example in published European patent application no. 0 812 577. This positioning and fixing system is used to align and permanently fix the transducer 15, based on the given individual anatomic circumstance in the artificial mastoid cavity, such that the sound-emitting transducer membrane 17 is as near the aditus ad antrum 41 as possible. The positioning and fixing system 38 includes a head plate 70 suitable for bone anchoring and a ball joint 72 fixed by a clamping mechanism 71 manually positioned using an auxiliary tool and attached to the head plate 70. The system 38 further includes a linear drive arrangement 74 which is permanently connected to the ball 73 of the ball joint 72, a carriage 75 guided along a guide of the linear drive arrangement 74 and a receiver 76 attached to the carriage 75 for the transducer housing 14. The carriage can be freely positioned manually along the guide via a drive. The transducer 15 is connected by means of an implantable electric lead wire 94 to an implantable, hermetically tightly sealed implant housing 200 via a signal feed-through 198.

The implant housing 200 is advantageously configured as in the known cochlea implants and in fully and partially implantable hearing aids such that it can be placed in an artificial bone bed on the mastoid plane behind the pertinent outer ear. The housing 200 contains the electronic unit 105 for signal generation of the masker or noiser and a primary or rechargeable battery 140 for power supply of the entire system. Advantageously, the electrical converter lead wire 94 is not permanently connected to the housing 200, but via a detachable connector 95 (shown in FIG. 6 as a block) which satisfies the corresponding implant requirement with respect to electrical insulation and tightness. A suitable connector is described, for example, in published commonly owned, U.S. Pat. No. 5,755,743.

FIG. 7 shows another embodiment of the implant system which enable considerable simplification by integrating the electroacoustic transducer 15 directly into the implant housing 200. To do this, a partial area of the hermetically tight and biocompatible implant housing 200 is made as a preferably circular membrane which represents the transducer membrane 17 according to FIG. 2. The implant housing 200 is configured geometrically to be surgically positioned and fixed over the artificial mastoid cavity 40 such that this soundemitting transducer membrane comes to rest as tightly as possible over the area of the aditus ad antrum 41. The sound waves 44 are supplied directly to the mastoid cavity 40 in this way and travel via the aditus ad antrum 41 into the tympanic cavity 42. For construction reasons, it can be advantageous to use the piezoelectric electromechanical transducer 15 shown in FIG. 3 to drive the housing membrane 17, since a simple overall structure and a short construction height of the implant housing 200 are possible. The housing 200 furthermore contains the signal generation unit 105, described in conjunction with FIG. 6, and the battery 140.

Figure 8:
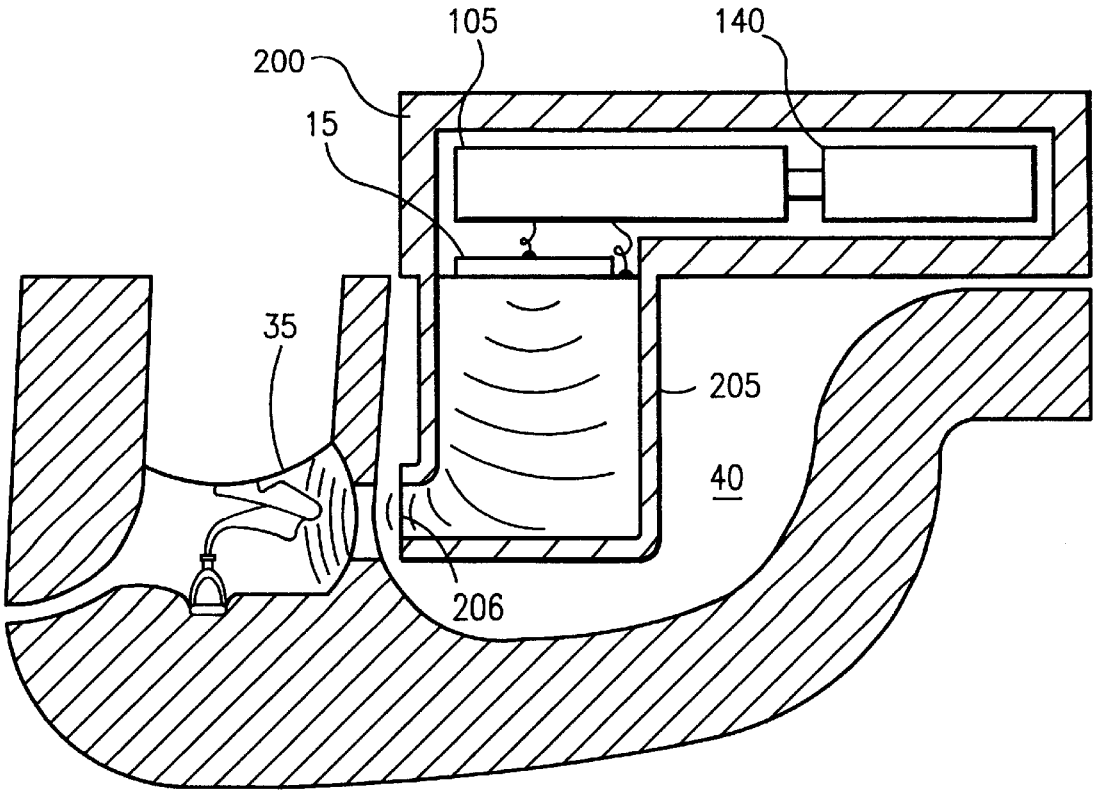

FIG. 8 illustrates a further optimization of the embodiment as shown in FIG. 7. The implant housing 200 is widened in the area of the housing membrane of the transducer 15 in a sound-tight manner with a sound-conducting element 205 which preferably has the shape of a tube or tube section. The sound conduction element is shaped such that its sound outlet opening 206 can be positioned as directly as possible opposite the aditus ad antrum 41 and thus optimum sound coupling into the tympanic cavity 42 is ensured. The implant housing 200 contains, in addition to the transducer 15, the signal generation unit 105 and the battery 140.

Figure 9:
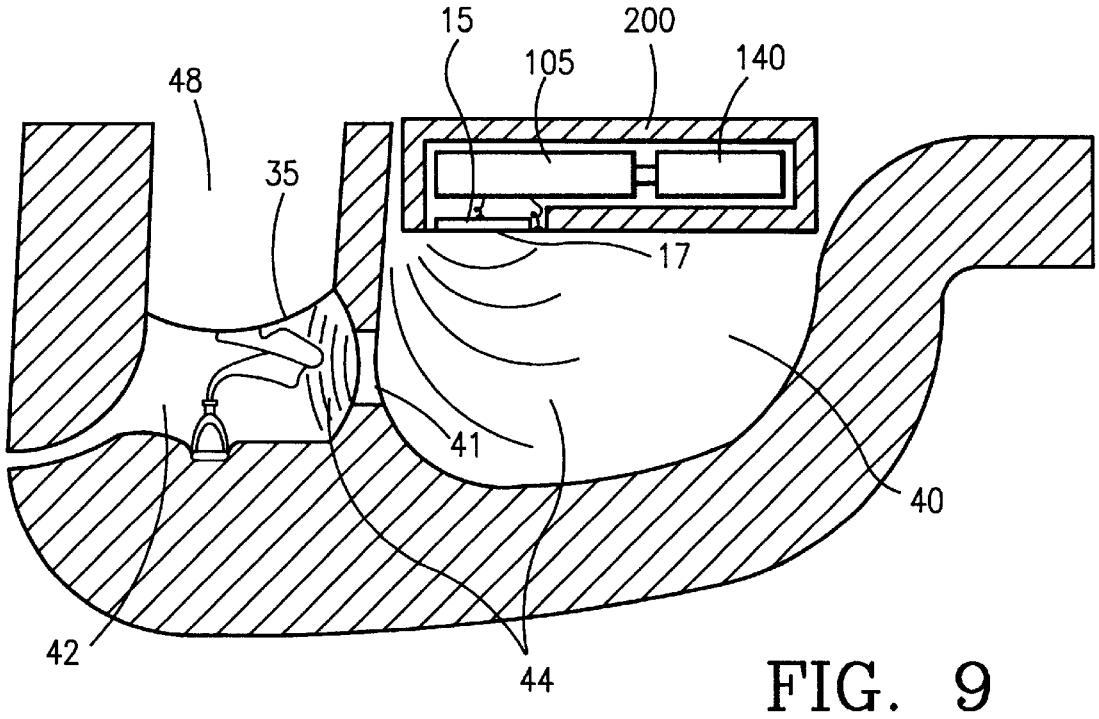

In the embodiment of FIG. 9, the principle from FIG. 7 is optimized such that the implant housing 200 is configured geometrically to be so small that it has room directly in the artificial mastoid cavity 40 and need not be positioned on the mastoid plane. This design has the advantage that the implant can no longer be touched after surgery and that the local vicinity of the aditus ad antrum 41 yields optimum sound coupling into the tympanic cavity 42, even without the sound conduction element 205 in FIG. 8.

Figure 10:
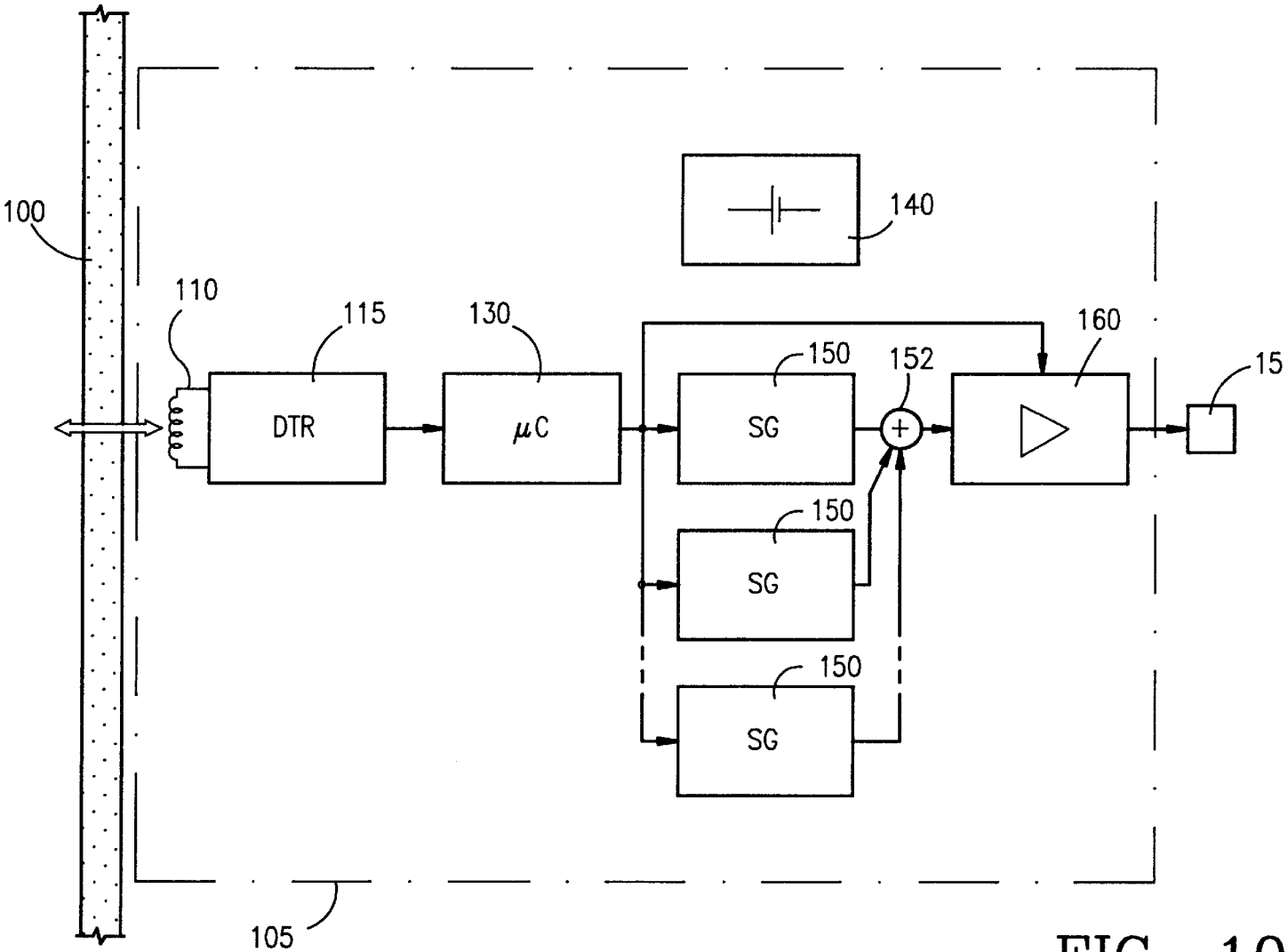
FIGS. 10 and 11 are schematic diagrams of two embodiments of the electronic unit of a fully implantable tinnitus masker or noiser.

FIG. 10 shows one possible structure of the signal generation unit 105 located within the implant. One or more signal generators 150 (SG) generate the signal or signals for achieving the masking sound or the noiser. The generators 150 can generate individual sinusoidal signals, narrowband noise and other suitable signal forms which as a result of psychoacoustic and audiological findings are optimum for the desired effect. The generators 150 can contain analog or purely digital signal generation, and can be adjusted with respect to frequency position, mutual phase angle, output level and spectral composition for broadband sounds especially of a stochastic type. The generators 150 are programmed via a microprocessor or microcontroller 130 ($\mu$C). The output signals of the generators 150 are combined in a summing element 152 and sent to a driver amplifier 160 which triggers the electroacoustic transducer 15. The driver amplifier 160 can also be adjusted via the controller 130, for example, with respect to its gain. The controller 130 acquires its individual program data via a data transmitter interface 115 (DT). The data is transmitted inductively via a receiving and transmitting coil 110 in one or both directions through the closed skin 100 from and to the outside world. The patient-specific data is filed in a long term, stable manner in a nonvolatile memory area of the controller 130. All the described components of the signal generation unit 105 are supplied with power from the primary or rechargeable secondary battery 140 which is accommodated in the implant housing. In the case of a rechargeable battery, transcutaneous charging links can be used, such as described, for example, in commonly owned, U.S. Pat. No. 5,279,292.

Figure 11:
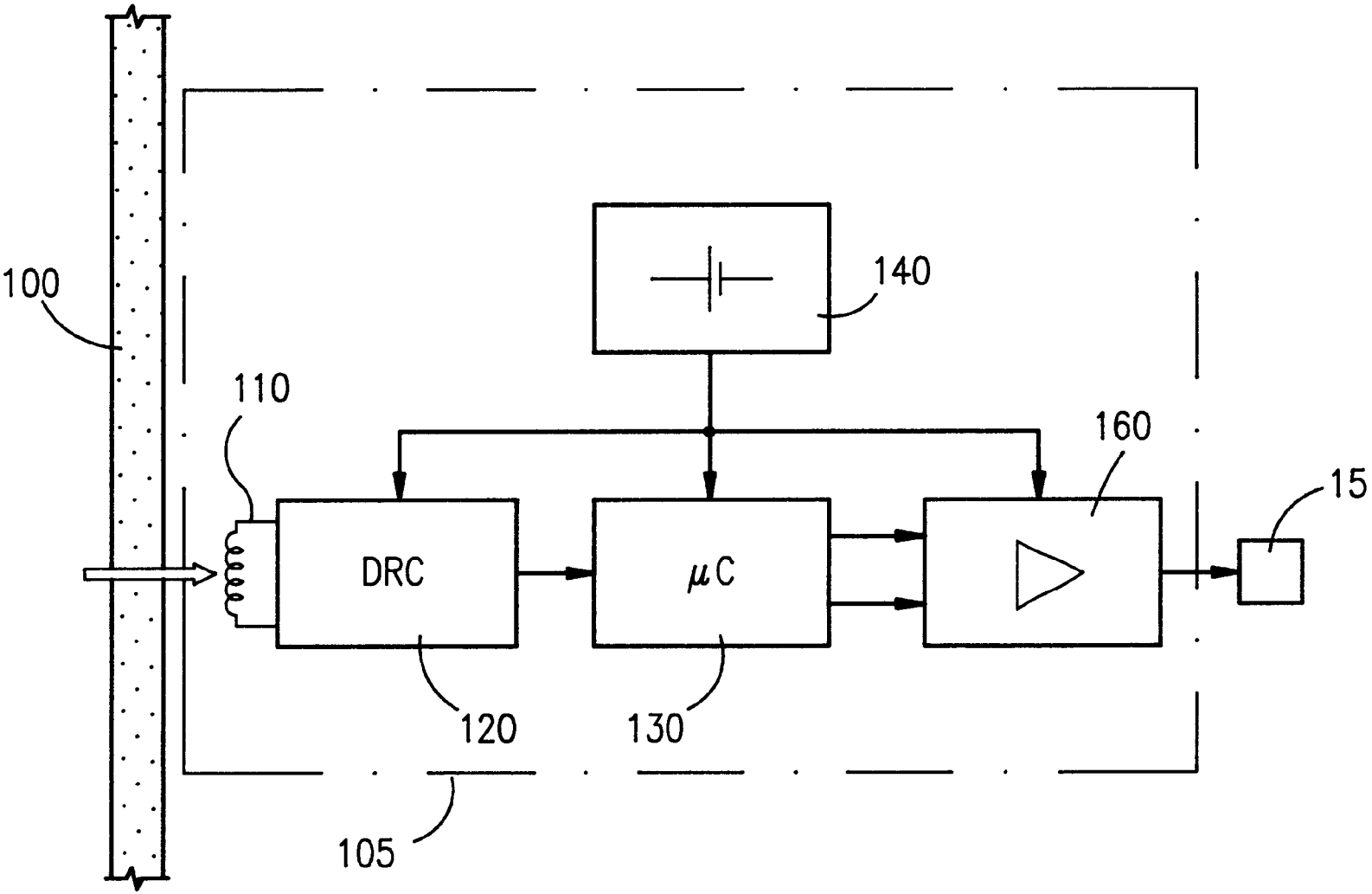

FIG. 11 illustrates a very simple, and therefore volume-optimized and economical, version of the signal generation unit 105. The masker or noiser signals are digitally generated directly by the microprocessor or microcontroller 130 ($\mu$C), amplified by the driver 160, and routed to the electroacoustic transducer 15. The driver amplifier 160 is adjusted in its gain and/or its transmission bandwidth digitally by the same controller 130. The controller 130 can be programmed from the outside via the unidirectional data receiving interface 120 (DCR), for example via inductive coupling through the closed skin 100. All components of the signal generation unit 105 are supplied with power by a preferably primary or rechargeable battery 140.

The version proposed in FIG. 11 is especially used in a pure noiser function. As expected, these systems require relatively low electrical operating energy since the output levels to be generated are low because the noiser sound signal can be placed only slightly above the auditory threshold. Therefore, in addition to implanted battery cells which are complex to recharge, a primary battery is used for supplying power to the entire implant. Preferably optimized lithium batteries of high capacity from cardiac pacemaker technology are used. If an available battery capacity of 2 Ah and a continuous power consumption of the system of roughly 0.1 mA are assumed, in 16 hours of daily operation, the service life is roughly 3.5 years. This minimized electronic unit can therefore preferably be combined with the system configuration according to FIG. 8 or FIG. 9, since in this way an economical implant can be produced and relatively simple, minimum-risk implantation is possible. After the service life of the battery is reached, the implant can be easily replaced under local anesthesia.

Figure 12:
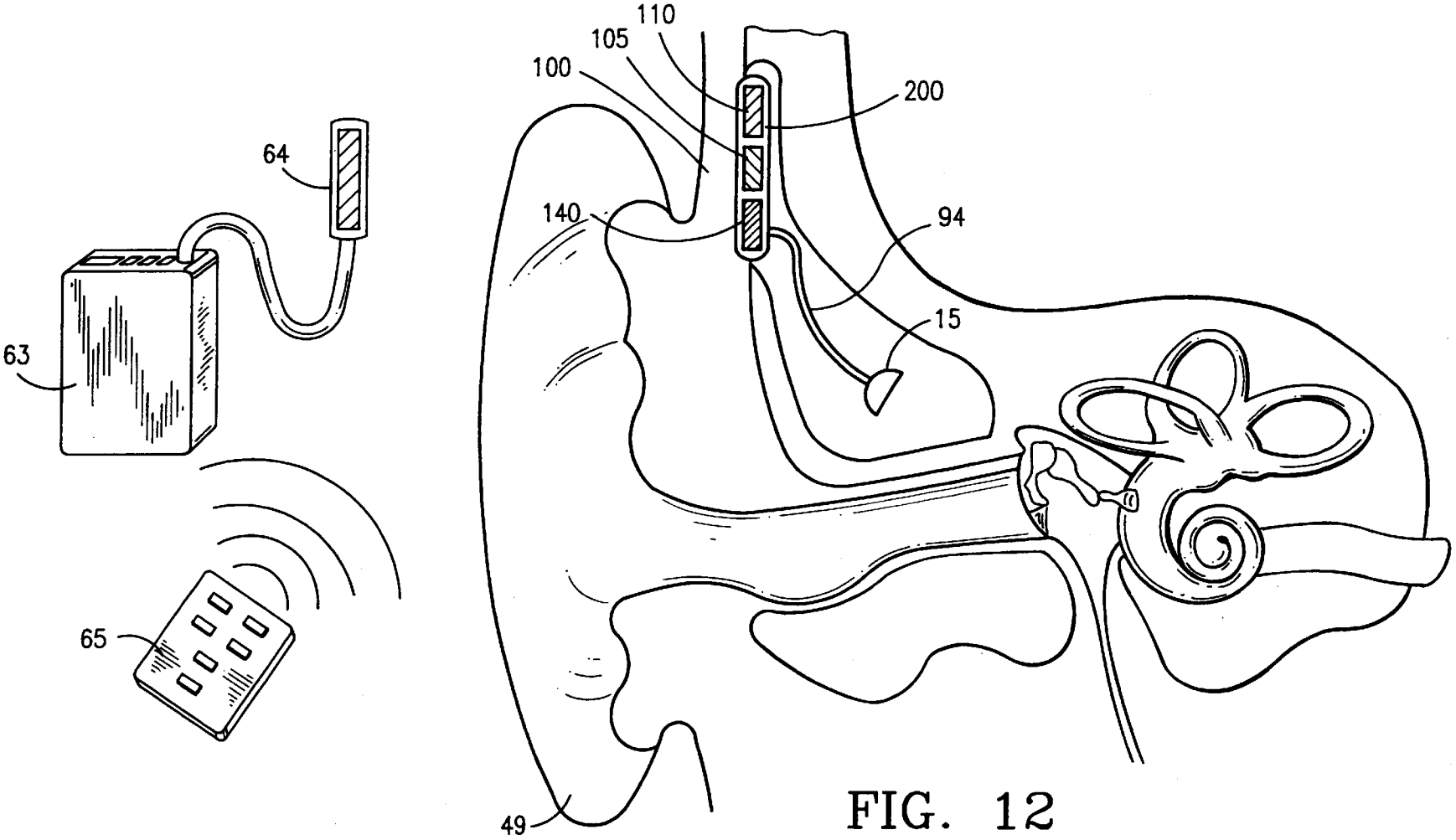
FIG. 12 illustrates the entire system of a fully implantable tinnitus masker or nosier in accordance with the present invention.

FIG. 12 shows the entire system of an implantable tinnitus masker or noiser using the electroacoustic transducer 15 according to FIG. 6. The converter positioning system 36 according to FIG. 6 is not shown. The implant housing 200, which contains a coil 110, a battery 140 and a signal generation unit 105, is placed in an artificial bone bed behind the outer ear 49 under the closed skin 100. The transducer 15 is connected to the implant by means of the electrical implant line 94. Furthermore, a programming unit 63 is shown which transfers programming data to the implant with, for example, an inductive telemetry head 64, or reads out data from the implant. To do this, the telemetry head 64 is placed behind the outer ear 49 over the implant until there is sufficient coupling with the coil 110 located within the implant and used as a data transmitter. The battery 140 can be a primary or rechargeable battery. In the case of a rechargeable battery, the unit 63 can be a portable, battery-operated transcutaneous charger. Accordingly, the head 64 then represents a power transmitting coil and the implant coil 110 represents a power receiving coil.

Furthermore, a portable and battery-operated remote control unit 65 is shown which may be provided in all the previously described versions of the implant system. With this wireless remote control, the patient can change basic functions of the implant system. In a minimum configuration case of the implant layout as per FIG. 9 and 11, the implant can only be turned on and off.

While various embodiments in accordance with the present invention have been shown and described, it is understood that the invention is not limited thereto, and is susceptible to numerous changes and modifications as known to those skilled in the art. Therefore, this invention is not limited to the details shown and described herein, and includes all such changes and modifications as are encompassed by the scope of the appended claims.

We claim:

1. An implantable device for treatment of tinnitus comprising:

an electronic signal generation unit;

a power source supplying power to the electronic signal generation unit;

a sound-delivering output transducer for receiving an electronic signal from the electronic signal generation unit and including a hermetically gas-tight, biocompatible and implantable electroacoustic transducer of a size and shape adapted to be positioned in a mastoid cavity such that the sound emitted from the electroacoustic transducer travels via a natural passage of an aditus ad antrum from the mastoid cavity to a tympanic cavity.

2. The device of claim 1, wherein the electroacoustic transducer includes a housing which is hermetically gas-tight on all sides, said housing including a wall made as a bendable membrane, said electroacoustic transducer further including an electromechanical drive unit positioned in the housing; wherein the drive unit is coupled to the bendable membrane such that output-side mechanical vibrations of the drive unit are mechanically coupled directly from inside of the housing to the bendable membrane to cause excitation of the membrane resulting in bending vibrations producing sound emission outside the transducer housing.

3. The device of claim 2, wherein the electromechanical drive unit is actuated based upon at least one of an electromagnetic, electrodynamic, dielectric, piezoelectric and magnetostrictive converter principle.

4. The device of claim 2, wherein the transducer housing is cylindrical.

5. The device of claim 2, wherein the bendable membrane is circular.

6. The device of claim 2, wherein the transducer housing includes a transducer housing part that is open on one side, said open side being sealed hermetically gas-tight by the bendable membrane.

7. The device of claim 6, wherein the transducer housing part is metallic.

8. The device of claim 2, wherein the bendable membrane is metallic.

9. The device of claim 7, wherein at least one of the transducer housing part and the bendable membrane are produced from a noncorrosive, stainless metal, especially high-quality steel.

10. The device of claim 7, wherein at least one of the transducer housing part and the bendable membrane are produced from a noncorrosive, stainless, physiologically compatible metal selected from the group consisting of titanium, platinum, niobium, tantalum and their alloys.

11. The device of claim 6, wherein the transducer housing part includes a hermetically gas-tight electrical housing feed-through.

12. The device of claim 11, wherein the housing feed-through is at least single-pole and a ground potential is on the transducer housing part.

13. The device of claim 11, wherein the housing feed-through is based on metal-ceramic connections which have been soldered gas-tight.

14. The device of claim 13, wherein the housing feed-through includes an insulator of aluminum oxide further including an electrical feed-through lead of at least one platinum-iridium wire.

15. The device of claim 6, wherein the electromechanical drive unit includes an electromechanically active element in the form of a circular piezoelectric ceramic wafer applied to an inside of the bendable membrane; said wafer together with the bendable membrane forming an electromechanically active heteromorph compound element.

16. The device of claim 15, wherein the piezoelectric ceramic wafer is made of lead zirconate titanate.

17. The device of claim 15, wherein a thickness of the bendable membrane and a thickness of the piezoelectric ceramic wafer are approximately the same and are in a range of from 0.025 mm to 0.15 mm.

18. The device of claim 15, wherein both the bendable membrane and the transducer housing part are electrically conductive; wherein the piezoelectric ceramic wafer is connected electrically conductively to the bendable membrane by an electrically conductive cement; and wherein the transducer housing part forms one of at least two electrical transducer terminals.

19. The device of claim 15, wherein a radius of the bendable membrane is larger than a radius of the piezoelectric ceramic wafer by a factor of 1.2 to 2.0.

20. The device of claim 2, wherein the electromechanical drive unit is an electromagnet arrangement including a component fixed relative to the transducer housing and a vibratory component coupled to an inside of the bendable membrane.

21. The device of claim 20, wherein the vibratory component is attached essentially in a center of the bendable membrane.

22. The device of claim 20, wherein a permanent magnet which forms the vibratory component is connected to the inside of the bendable membrane; and wherein an electromagnetic coil is attached securely in the transducer housing to cause the permanent magnet to vibrate.

23. The device of claim 22, wherein the permanent magnet is a magnet pin and the coil is a ring coil with a center opening into which the magnet pin dips.

24. The device of claim 2, wherein by selecting mechanical properties of the transducer membrane and the drive unit, a vibratory system which comprises these components is tuned such that a first mechanical resonant frequency of the transducer lies spectrally on the upper end of a transmission range.

25. The device of claim 2, wherein the drive unit is electrically triggered such that the deflection of the bendable membrane is impressed as far as a first resonant frequency, regardless of the frequency.

26. The device of claim 1, wherein the electronic signal generation unit is at least one of adjustable and programmable.

27. The device of claim 1, wherein the electroacoustic converter is held in an implantable positioning and fixing system and is adapted to be aligned to the aditus ad antrum by means of this system.

28. The device of claim 1, wherein the device is partially implantable, said device including an implantable unit including the electroacoustic transducer and an assigned signal receiving and driver circuit, said device further including a nonimplantable unit containing the signal generator unit and the electric power supply.

29. The device of claim 1, wherein the device is fully implantable.

30. The device of claim 29, wherein the signal generation unit together with the electric power supply, but separately from the electroacoustic transducer, is accommodated in an implantable, hermetically tightly sealed implant housing and is connected to the electroacoustic transducer via an implantable electric transducer lead wire.

31. The device of claim 30, wherein the transducer lead wire is connected to the implant housing via a detachable connector.

32. The device of claim 29, wherein the electroacoustic transducer is integrated into an implantable, hermetically tightly sealed implant housing which holds the signal generation unit and the electric power supply.

33. The device of claim 32, wherein a partial area of the hermetically tight implant housing which comes to rest in the implanted state over the area of the aditus ad antrum is made as a bendable membrane and wherein the implant is configured geometrically such that the implant is adapted to be positioned and fixed over the artificial mastoid cavity.

34. The device of claim 33, wherein a sound conduction element is attached to the implant housing in the area of the bendable membrane, with its side at a distance from the bendable membrane coming to rest in the implanted state opposite the aditus ad antrum.

35. The device of claim 32, wherein the implant housing is sized so that the implant housing is adapted to be received in the artificial mastoid cavity.

36. The device of claim 29, wherein the signal generation unit, which is located within the implant, includes at least two microprocessor programmable signal generators which are adjustable with respect to at least one of frequency position, mutual phase angle, output level and spectral composition of the generated signals, said signal generation unit further including a summing element for combining the signals of the signal generators.

37. The device of claim 36, further including an implantable receiving coil for transcutaneous reception of program data for the microprocessor and a data transmitter interface for transmission of the received program data from the receiving coil to the microprocessor.

38. The device of claim 29, further including a microprocessor which is used for signal generation, an implantable receiving coil for transcutaneous reception of program data for the microprocessor, and a data transmitter interface for transmission of the received program data from the receiving coil to the microprocessor.

39. The device of claim 38, further including a driver amplifier connected upstream of the electroacoustic transducer.

40. The device of claim 1, wherein at least one of a gain and a transmission bandwidth of the driver amplifier is adjustable by means of the microprocessor.

41. The device of claim 1, wherein the power source is a battery which is rechargeable by means of a transcutaneous charging link.

42. The device of claim 1, further including a portable, battery-operated remote control unit.

43. The device of claim 1, further including a programming unit with a telemetry head for at least one of transcutaneous transfer of programming data to the implant device and transcutaneous readout of data from the implant device.

44. The device of claim 19, wherein a radius of the transducer membrane is larger than a radius of the piezoelectric ceramic wafer by a factor of approximately 1.4.

* * * * *